US008051857B1

(12) United States Patent
Baptiste

(10) Patent No.: US 8,051,857 B1
(45) Date of Patent: Nov. 8, 2011

(54) COMBINED TOBACCO LEAF-ROLLED WRAPPERS AND PACKAGING

(76) Inventor: Schiller Baptiste, Brooklyn, NY (US)

( * ) Notice: Subject to any disclaimer, the term of this patent is extended or adjusted under 35 U.S.C. 154(b) by 999 days.

(21) Appl. No.: 11/904,205

(22) Filed: Sep. 26, 2007

(51) Int. Cl.
*A24C 3/00* (2006.01)
*A24C 5/00* (2006.01)
*A24C 5/60* (2006.01)

(52) U.S. Cl. ..... 131/28; 131/365; 131/360; 131/58; 206/249; 206/273; 206/257; 206/820

(58) Field of Classification Search ..... None
See application file for complete search history.

(56) References Cited

U.S. PATENT DOCUMENTS 5,005,698 A * 4/1991 Mikhail ..... 206/257
6,742,525 B2 * 6/2004 Sinclair, Jr. ..... 131/365

* cited by examiner

*Primary Examiner* — Richard Crispino
*Assistant Examiner* — Phu Nguyen

(57) ABSTRACT

Combined tobacco leaf-rolled wrappers and packaging includes a water-impermeable carrying case with an open top end that is provided with a lid pivotally coupled to a longitudinal side thereof such that the lid covers the top end when articulated to a closed position. The apparatus further includes a plurality of flexible and uniformly shaped tobacco leaves adapted to a rolled and tubular position and a mechanism for maintaining the rolled tobacco leaves in a sealed and air-tight condition while nested within the carrying case so that the rolled tobacco leaves are prevented from becoming saturated with humidity in ambient air.

8 Claims, 15 Drawing Sheets

COMBINED TOBACCO LEAF-ROLLED WRAPPERS AND PACKAGING

CROSS REFERENCE TO RELATED APPLICATIONS

This application claims the benefit of U.S. Provisional Application No. 60/826,570, filed Sep. 22, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to tobacco wrappers and, more particularly, to combined tobacco leaf-rolled wrappers and packaging for creating home-made cigarettes.

2. Prior Art

Cigarettes have been around for many centuries, but it wasn't until the 1800s that they gained their paper wrappers and came to some degree of acceptability. In France, especially with women, smoking cigarettes was considered the height of fashion. Ask any smoker today why they find so much pleasure in a cigarette and it is very likely that a plethora of reasons will be given. Whether inhaling the sweet tobacco calms the nerves during stressful times or simply holding a cylindrical smoke allows one to feel enveloped in an aura of cool, smoking provides much enjoyment to the many who indulge in this habit.

While cigarettes are very popular, quality smokes tend to be extremely expensive, especially for college students and financially-struggling young adults just entering the job market. Premium brands can cost, on the low end, between $5.00 and $8.00 per pack in some areas of the country. Seeking a way to enjoy a good cigarette without having to pay a fortune, young smokers often choose to just make their own. One solution is to purchase cheap, inferior paper, then wrap up their own chosen blends inside. While this method may be an effective way for cash-strapped individuals to create an affordable smoke, such a makeshift means can lack glamour and sophistication when image is just as important as taste. Obviously, it would be advantageous to provide users an affordable means to produce their own quality cigarettes.

U.S. Pat. No. 7,234,471 to Fitzgerald discloses cigarettes that possess smokable rods having paper wrapping materials having additive materials applied thereto as patterns. The additive materials, which can have the forms of liquid or paste formulations (e.g., aqueous formulations incorporating starch or modified starch), are applied to a continuous paper web on the cigarette making apparatus. The formulation is applied to the paper web using an application apparatus possessing rollers or a series of rollers. For example, additive material is applied to the roll face of a transfer roller due to roll interaction of that transfer roller with a pick-up roller; roll interaction of the transfer roller with an application roller causes transfer of the additive material from the transfer roller to the application roller; and additive material from the application roller is transferred to the paper web that passes between the application roller and a back-up roller. A radiant dryer is used to dry the additive material that has been applied to the paper web. The radiant dryer is located on one component of a two component assembly that is used to manufacture cigarettes. A first component of the two component assembly provides a source of paper web, applies additive material to that web in a pattern and dries the paper web; while a second component receives the paper web, supplies tobacco filler and manufactures a cigarette rod from the paper web and tobacco filler. Unfortunately, this prior art example does not provide a method for allowing a user to wrap their own cigarettes.

U.S. Pat. No. 7,216,652 to Fournier discloses a tobacco smoking article wrapper which selectively reduces the content of gaseous components in the smoke delivered during the use of the smoking article. The gaseous components can be low molecular weight aldehydes in the smoke produced during combustion/pyrolysis of the smoking article. The wrapper can comprise cigarette paper having an ammonium-containing compound filler therein for reducing the aldehyde content in the smoke. The ammonium-containing compound filler evolves ammonia upon combustion/pyrolysis of the smoking article which can chemically react with aldehydes in tobacco smoke and/or modify the combustion/pyrolysis reactions thereby reducing the initial formation of aldehydes to selectively reduce such aldehydes from the smoke inhaled by a smoker. The ammonium-containing compound can be magnesium ammonium phosphate used alone or in combination with one or more other fillers such as calcium carbonate. Unfortunately, this prior art example does not provide a method for allowing a user to wrap their own cigarettes.

U.S. Pat. No. 6,935,346 to Bushby discloses a smoking article comprising a wrapper enwrapping a tobacco smoking material. The wrapper comprising a ceramic material and is capable of mechanically trapping mainly aqueous particulate phase materials in the sidestream smoke, thereby reducing sidestream smoke deliveries considerably despite the use of the wrapper with conventional tobacco materials. Unfortunately, this prior art example does not provide a method for allowing a user to wrap their own cigarettes.

Accordingly, the present invention is disclosed in order to overcome the above noted shortcomings. The present invention satisfies such a need by providing an apparatus that is convenient and easy to use, lightweight yet durable in design, and designed for creating home-made cigarettes. The present invention is simple to use, inexpensive, and designed for many years of repeated use.

BRIEF SUMMARY OF THE INVENTION

In view of the foregoing background, it is therefore an object of the present invention to provide an apparatus for creating home-made cigarettes. These and other objects, features, and advantages of the invention are provided by combined tobacco leaf-rolled wrappers and packaging.

Combined tobacco leaf-rolled wrappers and packaging includes a water-impermeable carrying case with an open top end that is effectively provided with a lid pivotally coupled to a longitudinal side thereof such that the lid covers the top end when articulated to a closed position.

The apparatus further includes a plurality of flexible and uniformly shaped tobacco leaves conveniently adapted to a rolled and tubular position. Each of such rolled tobacco leaves is separately housed within the carrying case and spaced from each other. Each of the rolled tobacco leaves includes an adhesive layer contiguously conjoined to a top surface of each of the rolled tobacco leaves and spanning along a first longitudinal edge thereof. An outer surface of the rolled tobacco leaves is advantageously pressed against the adhesive layer during smoking procedures, and the rolled tobacco leaves are coextensively shaped.

The apparatus further includes a mechanism for maintaining the rolled tobacco leaves in a sealed and air-tight condition while nested within the carrying case so that the rolled tobacco leaves are effectively prevented from becoming saturated with humidity in ambient air. Such a sealed and air-tight maintaining mechanism includes a plurality of isolated compartments formed within the carrying case. Each of such compartments is conveniently juxtaposed side-by-side and vertically oriented along an entire width of the carrying case. Each of the compartments further has open top ends evenly situated along the open top end of the carrying case.

The maintaining mechanism further includes a segmented sheet of water-impermeable material covering an entire surface area of the open top end of the carrying case. Such a segmented sheet includes a plurality of perforations defining lines of weaknesses situated along perimeters of the compartments and along which a plurality of sheet segments are removably affixed to the top ends of the compartments respectively such that selected ones of the sheet segments are independently detachable from corresponding ones of the compartments while remaining ones of the sheet segments stay attached to corresponding ones of the compartments during non-use conditions. Each of the sheet segments is uniformly situated along a perimeter of the open top ends of the compartments, and each of the compartments advantageously shares at least two side walls with an adjoining compartment respectively.

A method for utilizing combined tobacco leaf-rolled wrappers and packaging for creating home-made cigarettes includes the steps of: providing a water-impermeable carrying case with an open top end that is provided with a lid pivotally coupled to a longitudinal side thereof such that the lid covers the top end when articulated to a closed position; providing a plurality of flexible and uniformly shaped tobacco leaves adapted to a rolled and tubular position; separately housing each of the rolled tobacco leaves within the carrying case by spacing each of the rolled tobacco leaves from each other; and maintaining the rolled tobacco leaves in a sealed and air-tight condition while nested within the carrying case so that the rolled tobacco leaves are prevented from becoming saturated with humidity in ambient air.

The method further includes the step of providing a plurality of isolated compartments formed within the carrying case. Each of such compartments is juxtaposed side-by-side and vertically oriented along an entire width of the carrying case, and each of the compartments has open top ends evenly situated along the open top end of the carrying case. The steps further include: positioning a segmented sheet of water-impermeable material over an entire surface area of the open top end of the carrying case; perforating the segmented sheet by defining lines of weaknesses along perimeters of the compartments such that a plurality of sheet segments are removably affixed to the top ends of the compartments respectively; and independently detaching selected ones of the sheet segments from corresponding ones of the compartments while remaining ones of the sheet segments stay attached to corresponding ones of the compartments during non-use conditions.

The method further includes the steps of: contiguously conjoining an adhesive layer to a top surface of each of the rolled tobacco leaves by spanning the adhesive layer along a first longitudinal edge thereof; and pressing an outer surface of the rolled tobacco leaves against the adhesive layer during smoking procedures.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
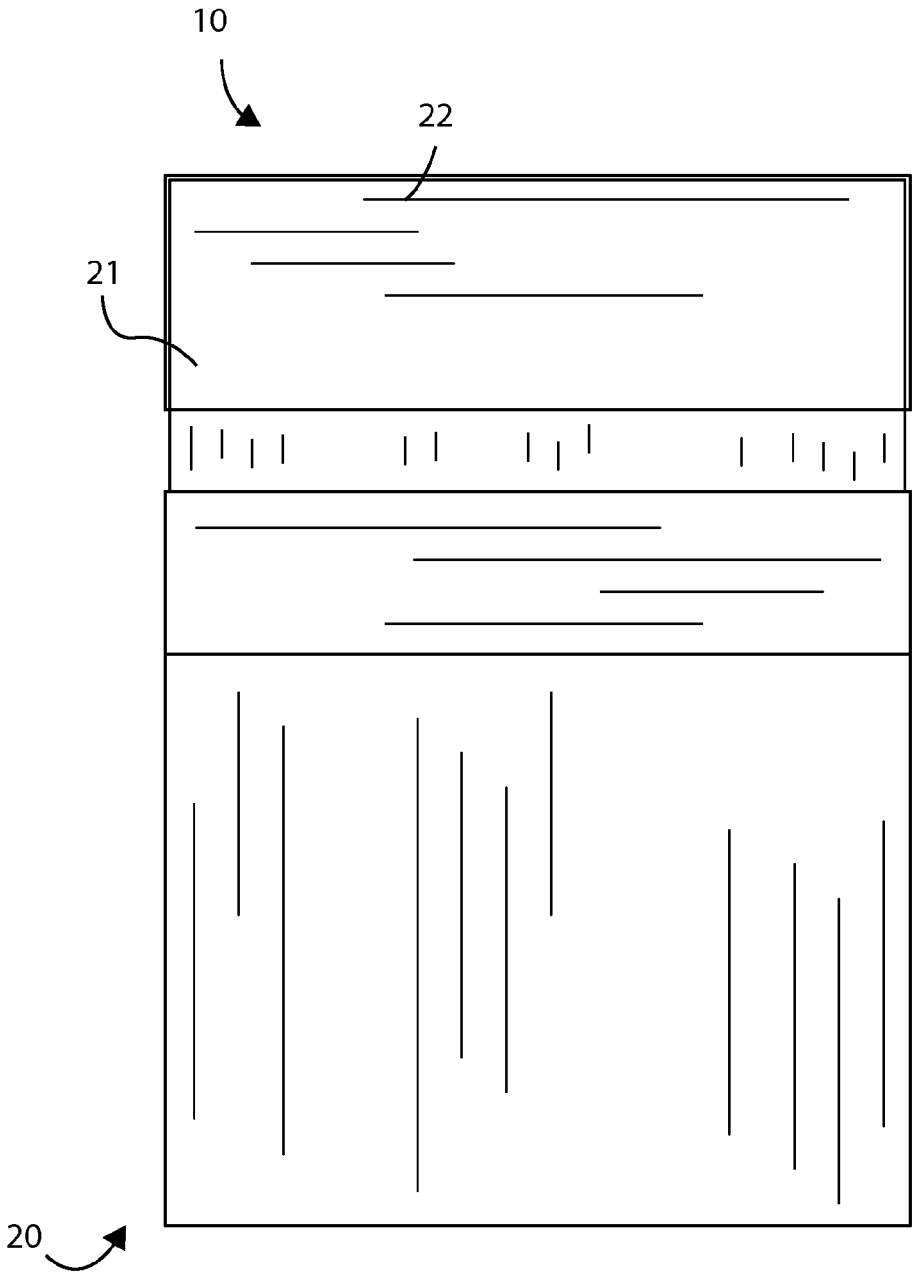
FIG. 1 is a front elevational view of the carrying case, with the lid open, in accordance with the present invention.
Figure 2:
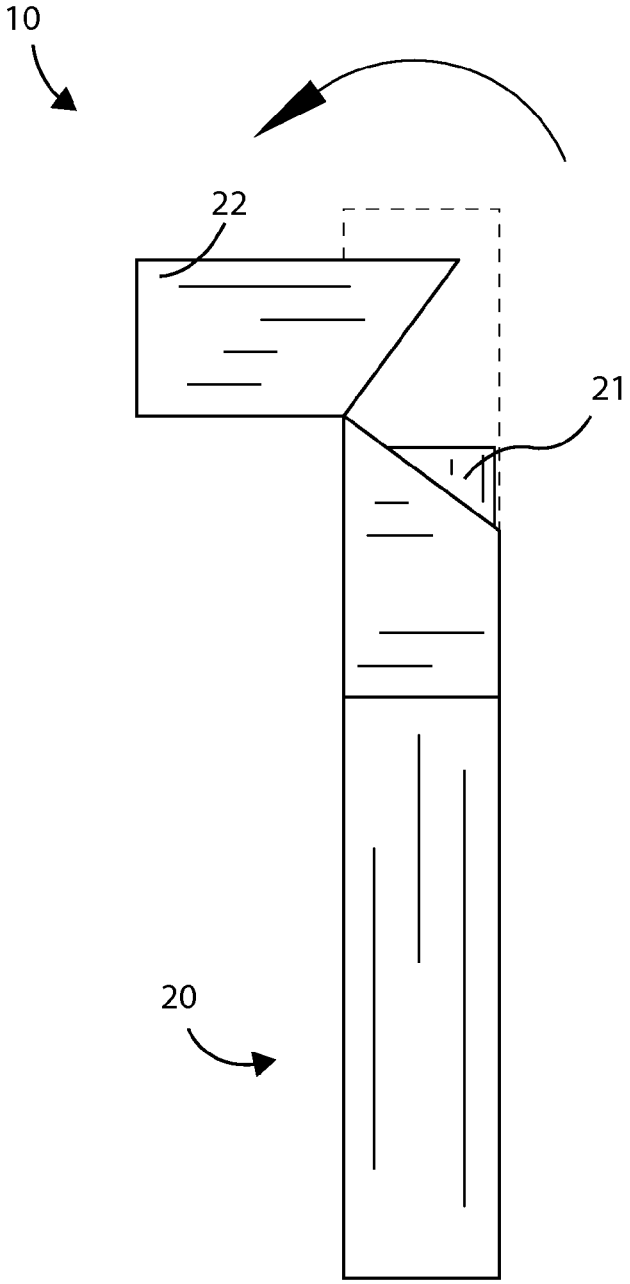
FIG. 2 is a side elevational view of the carrying case, with the lid open, in accordance with the present invention.
Figure 3:
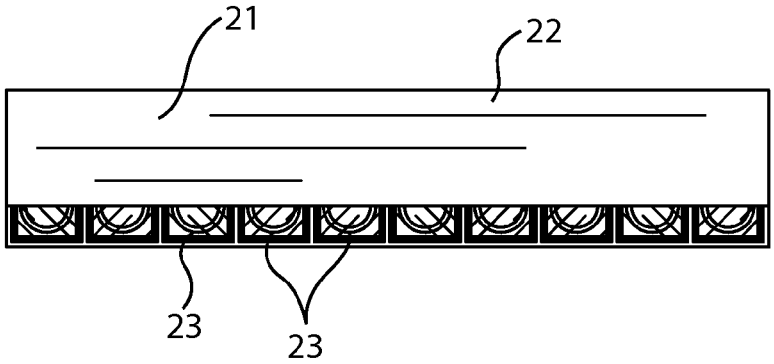
FIG. 3 is a top planar view of the carrying case, with the lid open, in accordance with the present invention.
Figure 4:
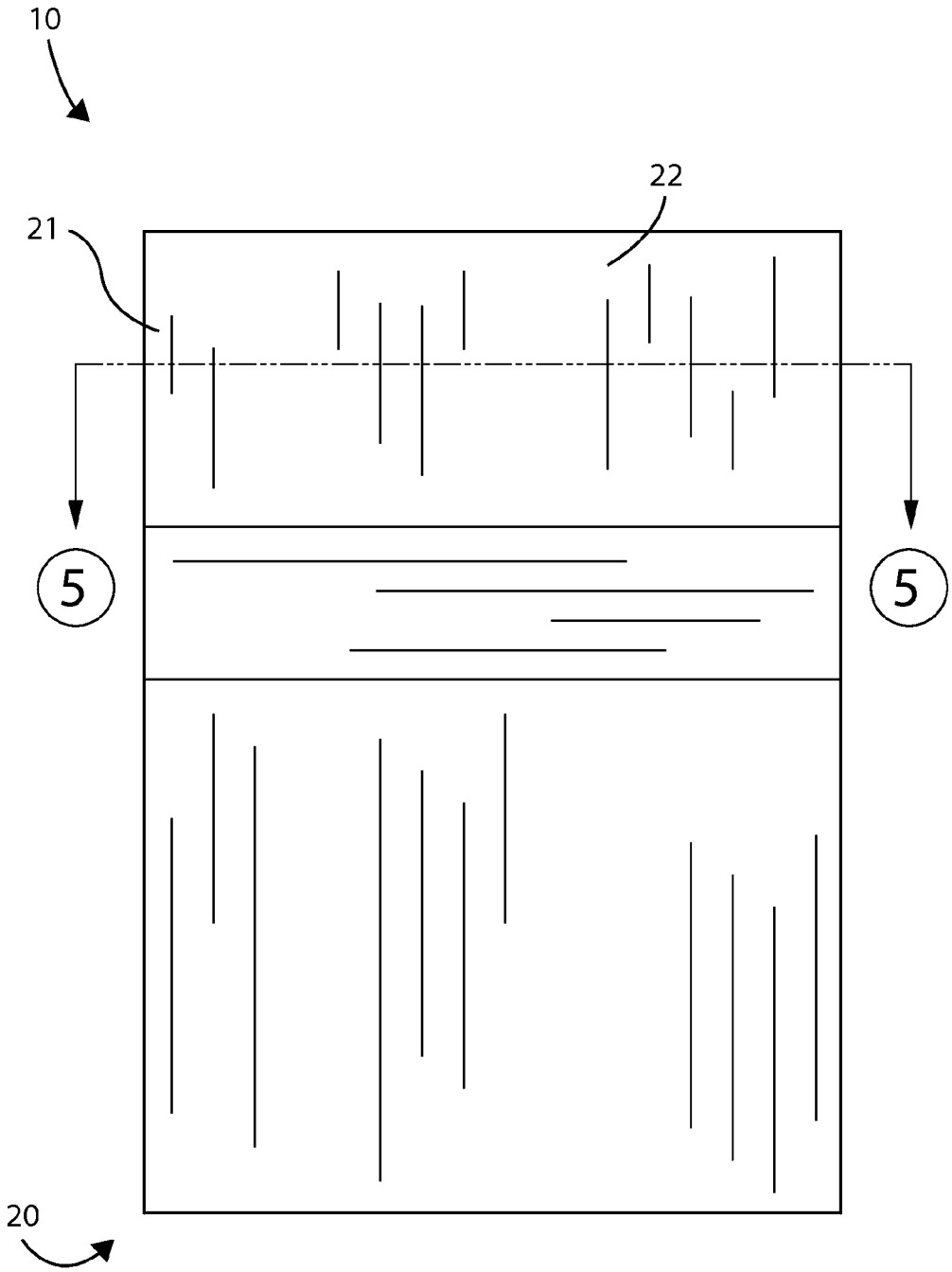
FIG. 4 is a front elevational view of the carrying case, with the lid closed, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-15 by the reference numeral 10 and 10', and is intended to protect combined tobacco leaf-rolled wrappers and packaging. It should be understood that the apparatus 10 and 10' may be used to wrap many different types of smoking products and should not be limited in use with only those products mentioned herein.

Referring initially to FIGS. 1, 2, 3 and 4, combined tobacco leaf-rolled wrappers and packaging 10 includes a water-impermeable carrying case 20 with an open top end 21 that is provided with a lid 22 pivotally coupled to a longitudinal side thereof which is essential such that the lid 22 covers the top end 21 when articulated to a closed position. The carrying case 20 ensures that the wrappers remain dry, fresh, and undamaged.

Figure 7:
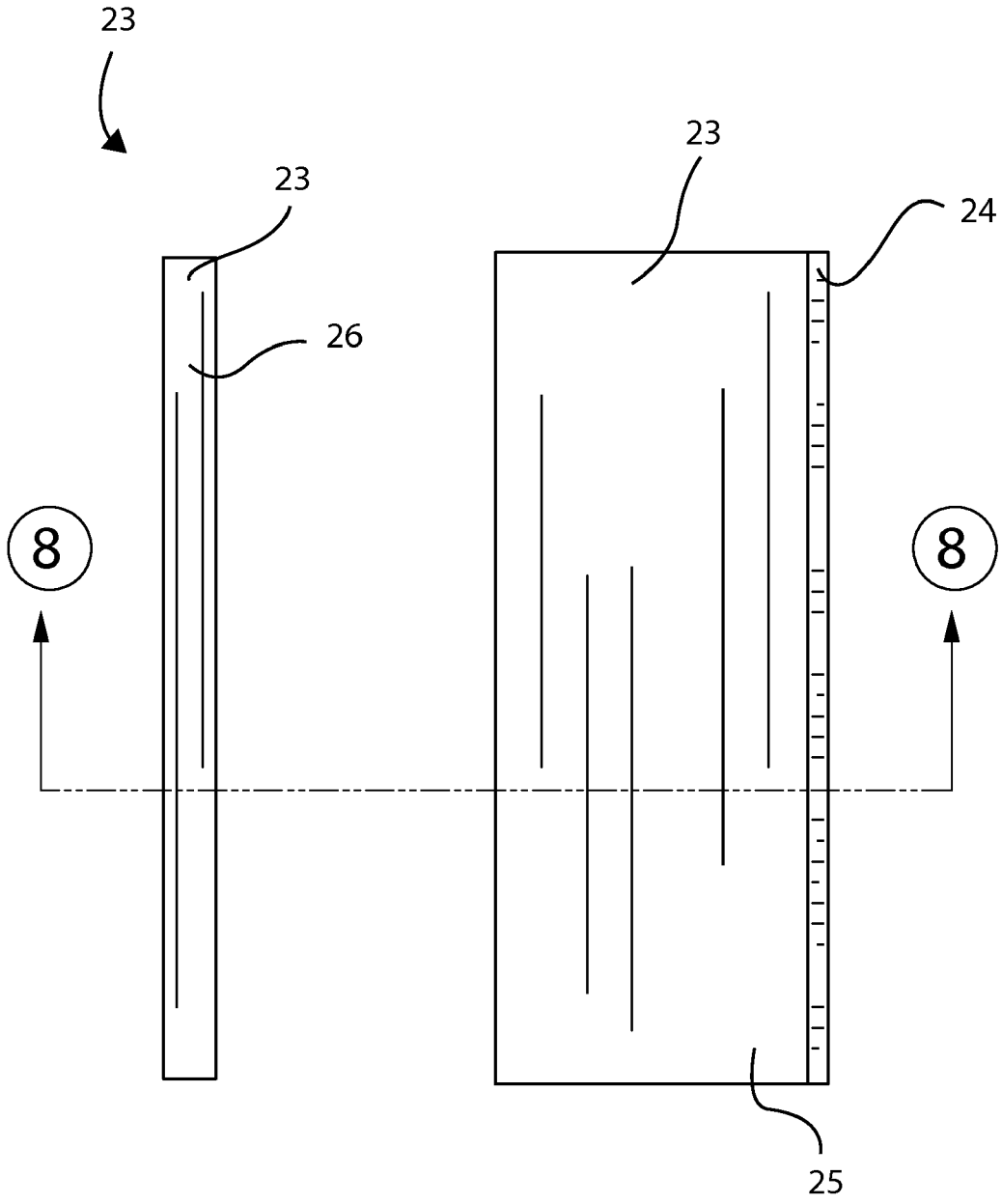
FIG. 7 is a top planar view of a tobacco leaf, rolled and unrolled, respectively, in accordance with the present invention.
Figure 8:
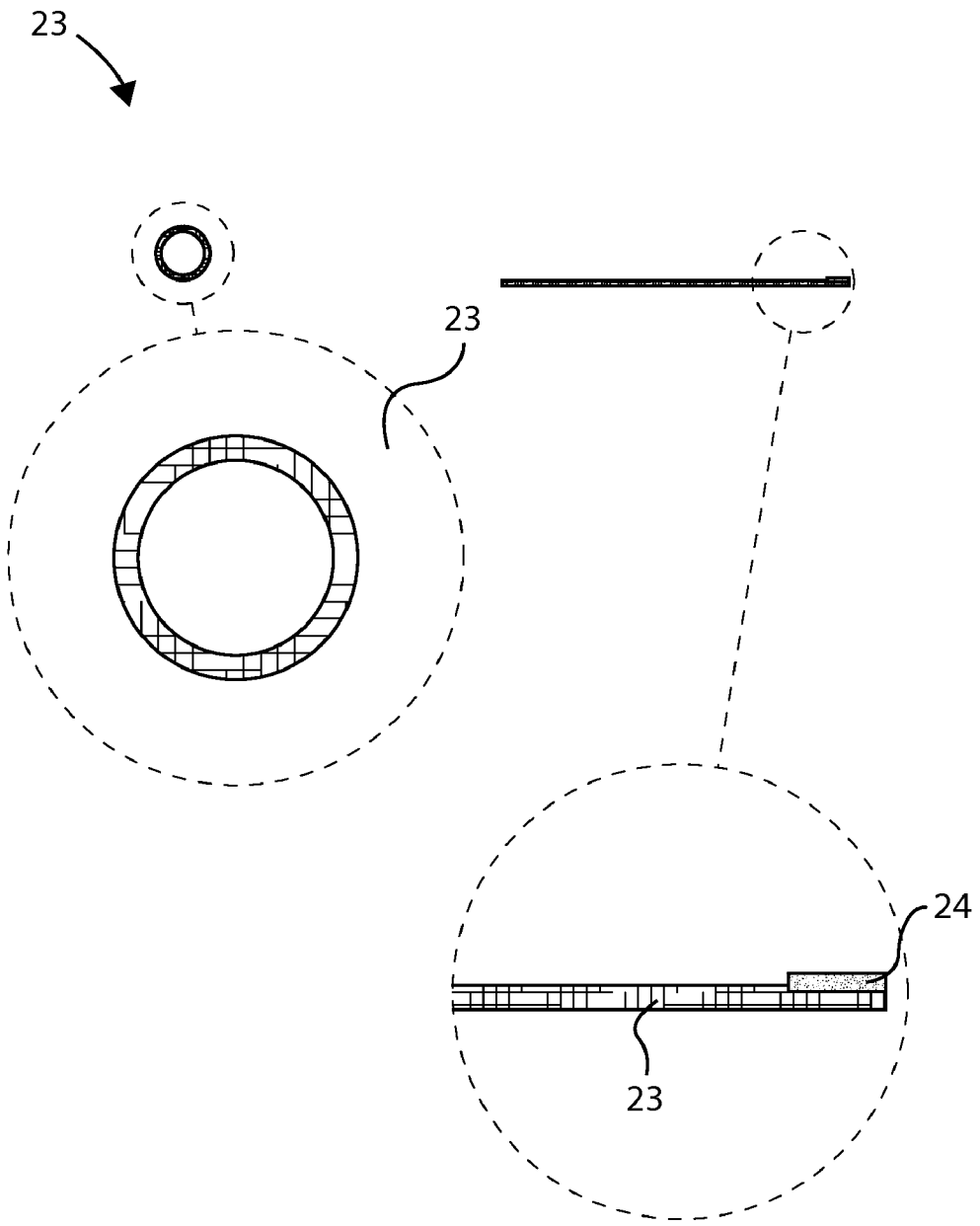
FIG. 8 is a cross sectional view, taken along line 8-8, in accordance with the present invention.
Figure 9:
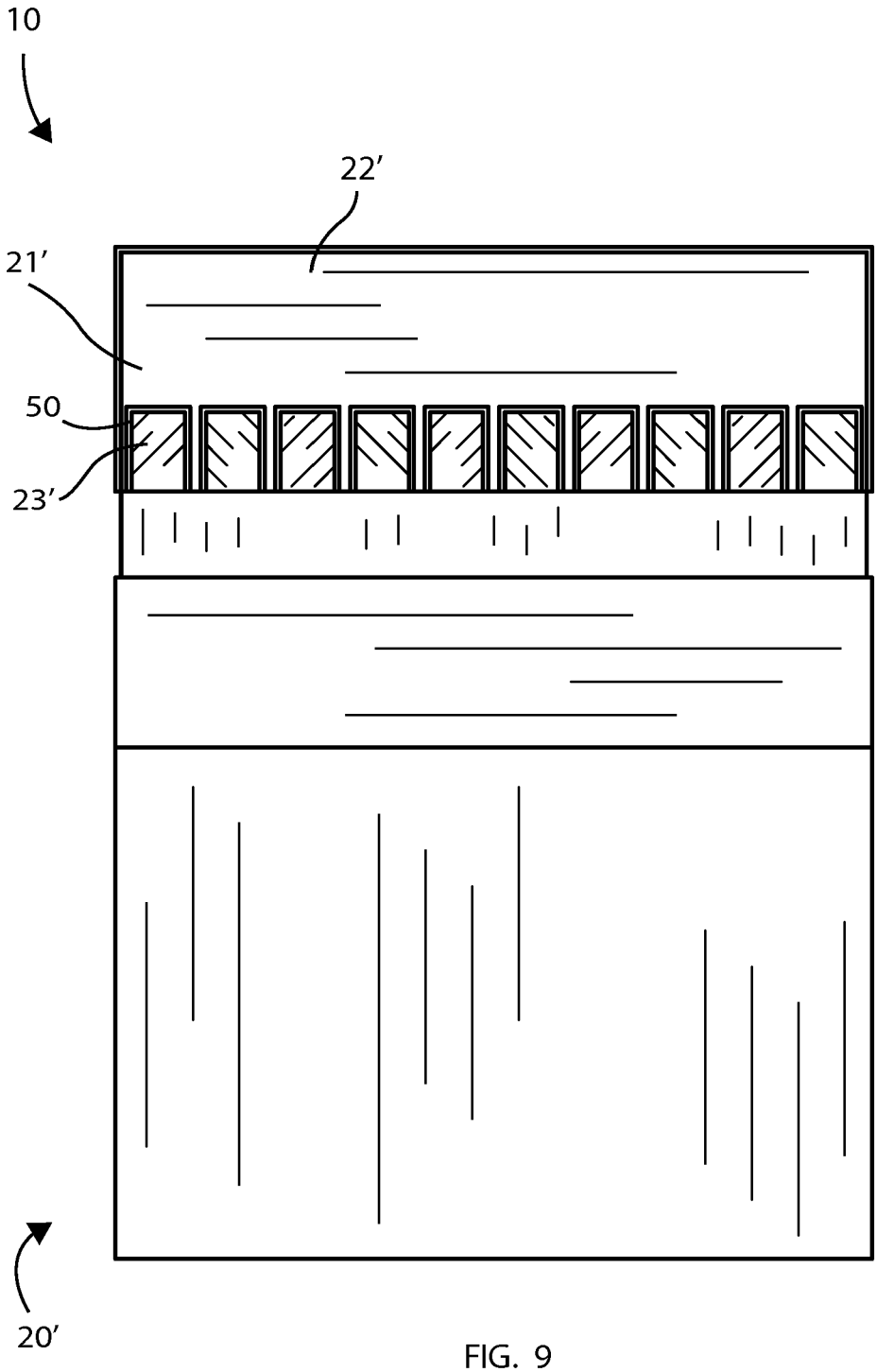
FIG. 9 is a front elevational view of the carrying case, with the lid open, in an alternate embodiment of the present invention.
Figure 10:
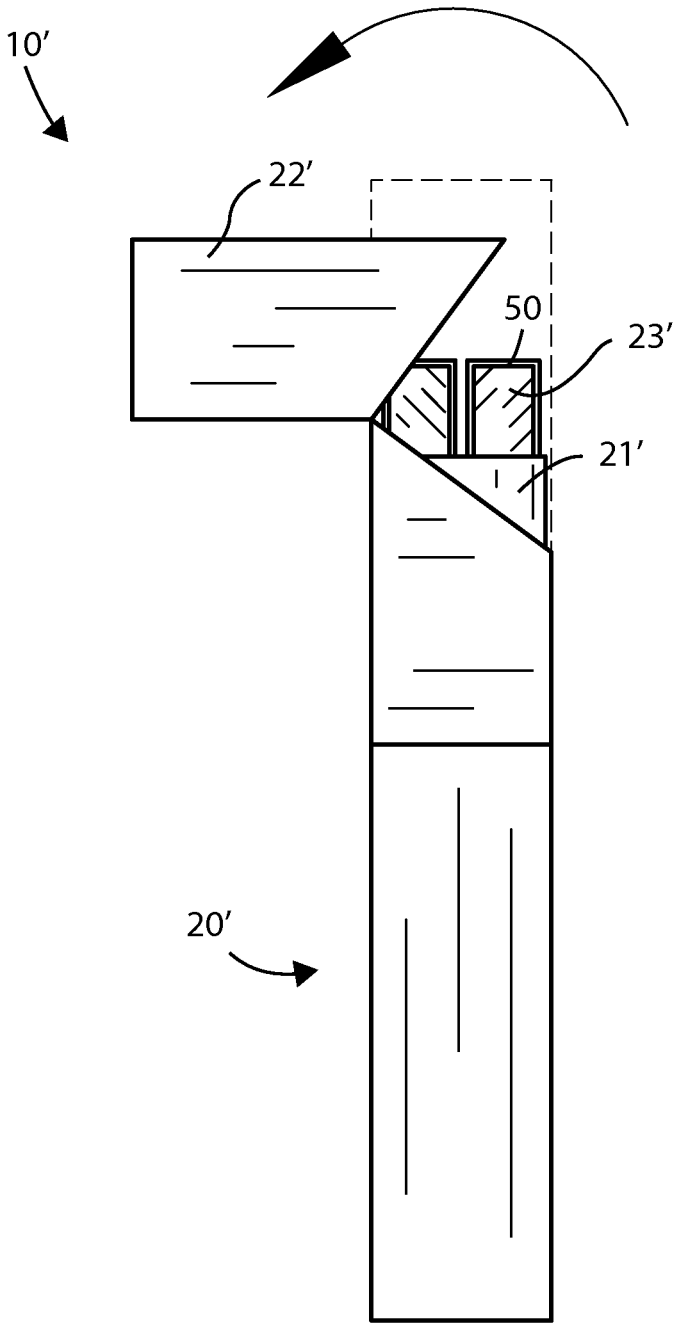
FIG. 10 is a side elevational view of the carrying case, with the lid open, in an alternate embodiment of the present invention.
Figure 11:
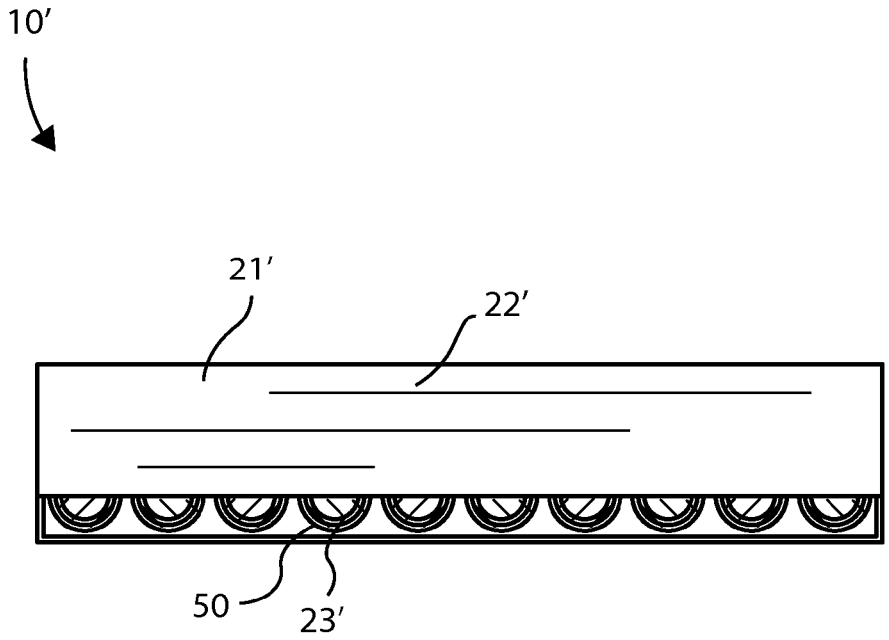
FIG. 11 is a top planar view of the carrying case, with the lid open, in an alternate embodiment of the present invention.
Figure 12:
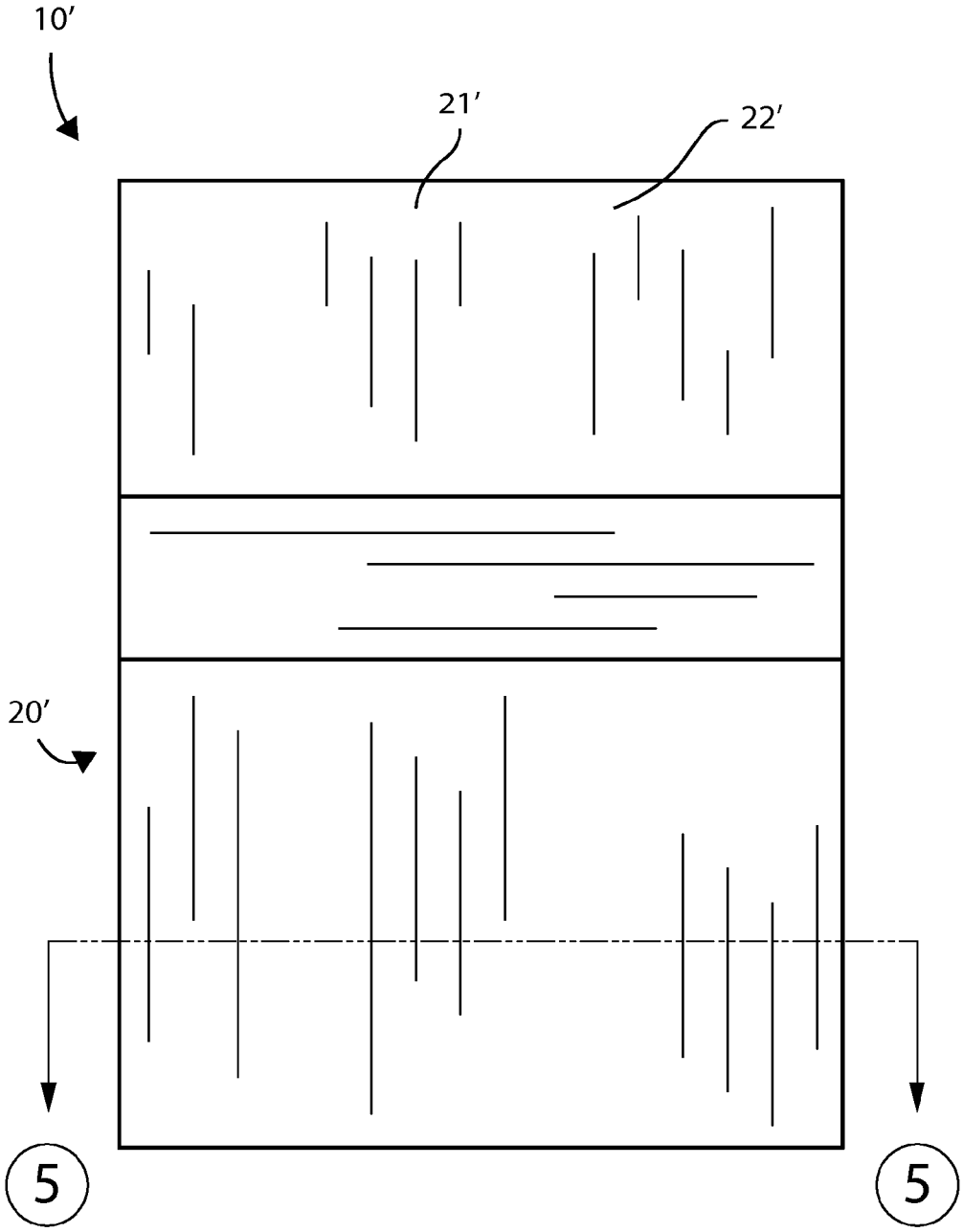
FIG. 12 is a front elevational view of the carrying case, with the lid closed, in an alternate embodiment of the present invention.
Figure 13:
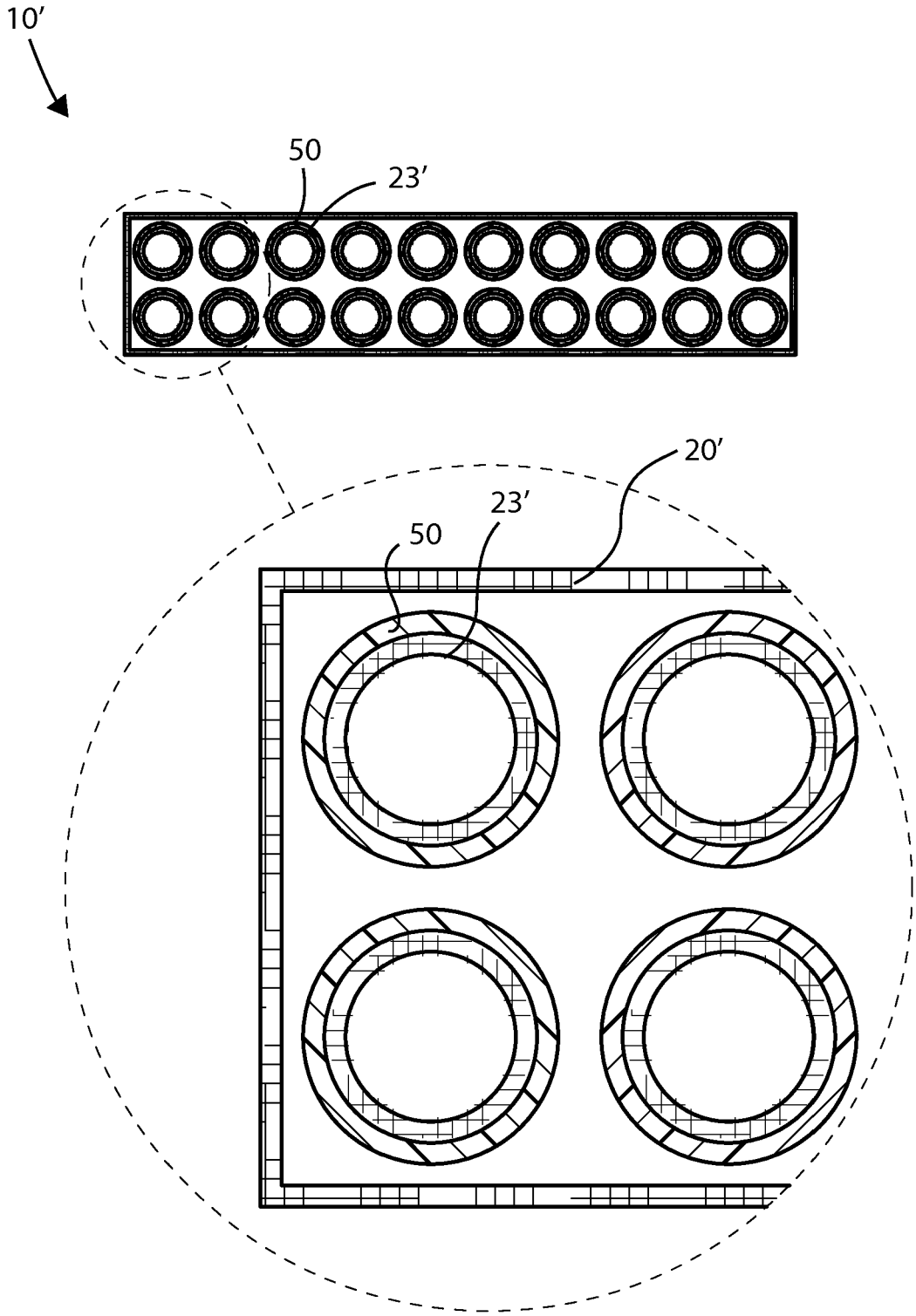
FIG. 13 is a cross sectional view, taken along line 5-5, as seen in FIG. 12.
Figure 14:
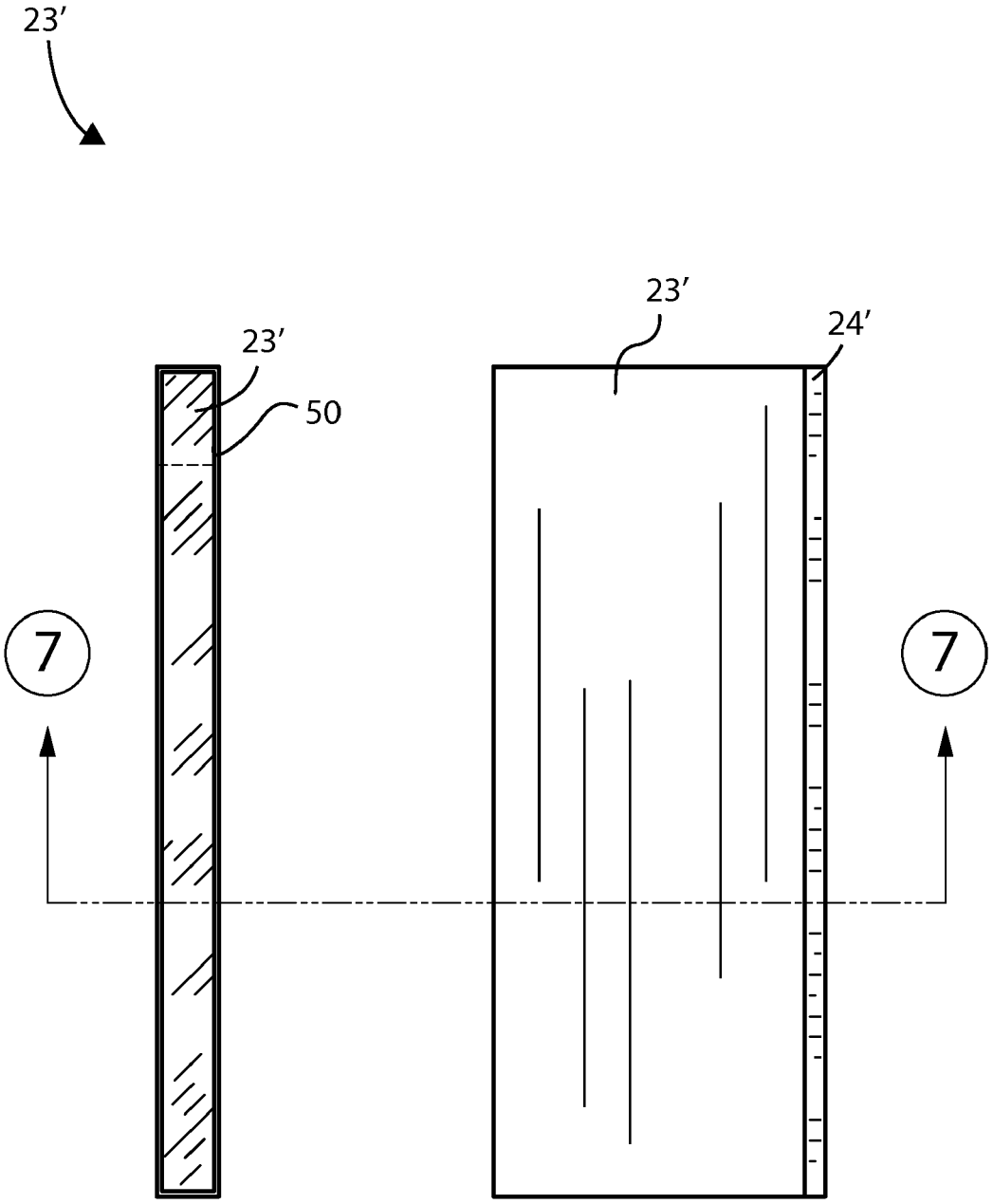
FIG. 14 is a top planar view of a tobacco leaf, rolled and unrolled, respectively, in an alternate embodiment of the present invention.
Figure 15:
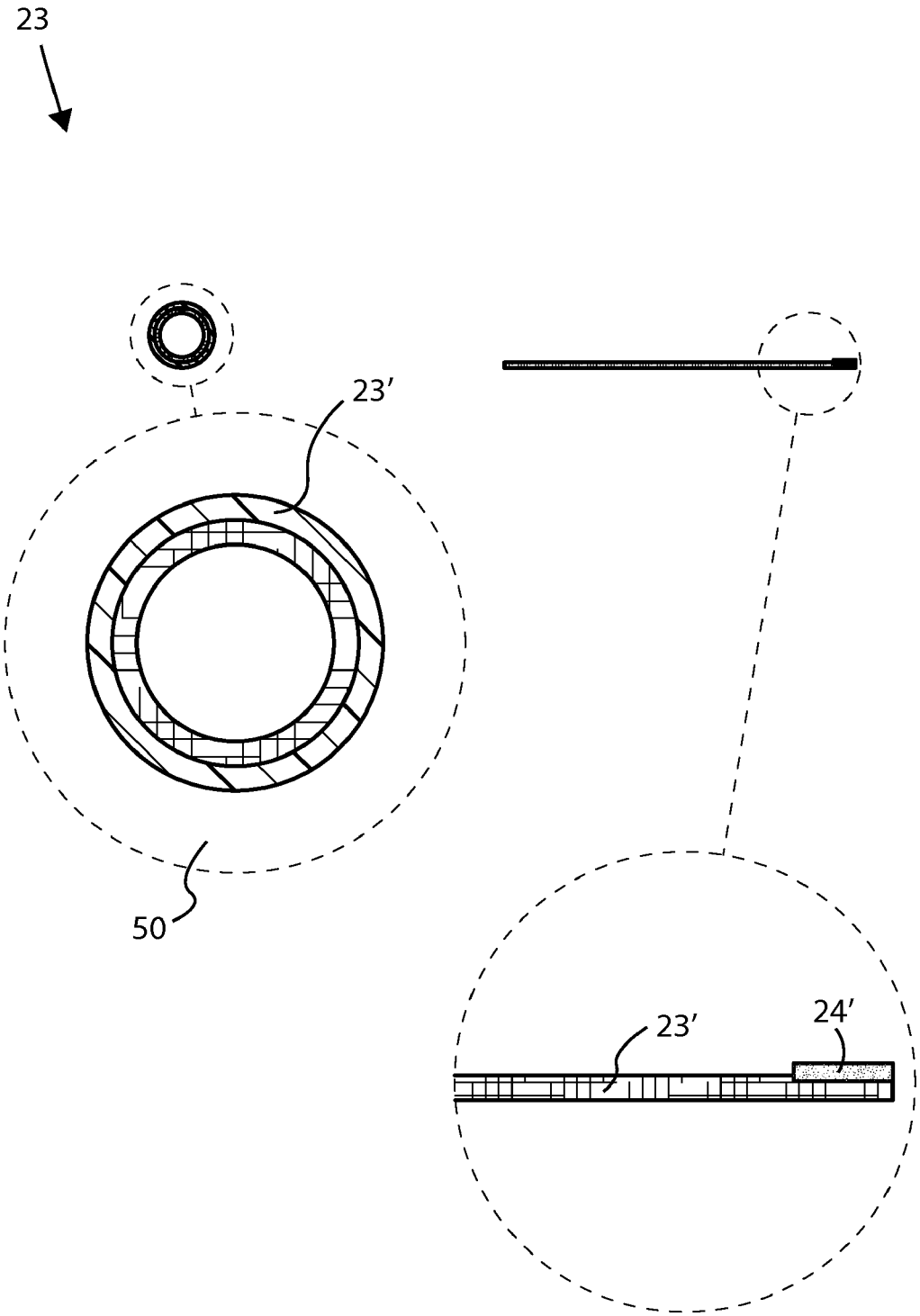
FIG. 15 is a cross sectional view, taken along line 7-7, as seen in FIG. 14.

Referring to FIGS. 7 and 8, the apparatus 10 further includes a plurality of flexible and uniformly shaped tobacco leaves 23 adapted to a rolled and tubular position. Each of such rolled tobacco leaves 23 is separately housed within the carrying case 20 and spaced from each other. Each of the rolled tobacco leaves 23 includes an adhesive layer 24 contiguously conjoined to a top surface 25 of each of the rolled tobacco leaves 23 and spanning along a first longitudinal edge thereof. An outer surface 26 of the rolled tobacco leaves 23 is pressed against the adhesive layer during smoking procedures, and the rolled tobacco leaves 23 are coextensively shaped. The rolled tobacco leaves 23 are used for wrapping a tobacco product and add additional taste to any cigarette.

Figure 5:
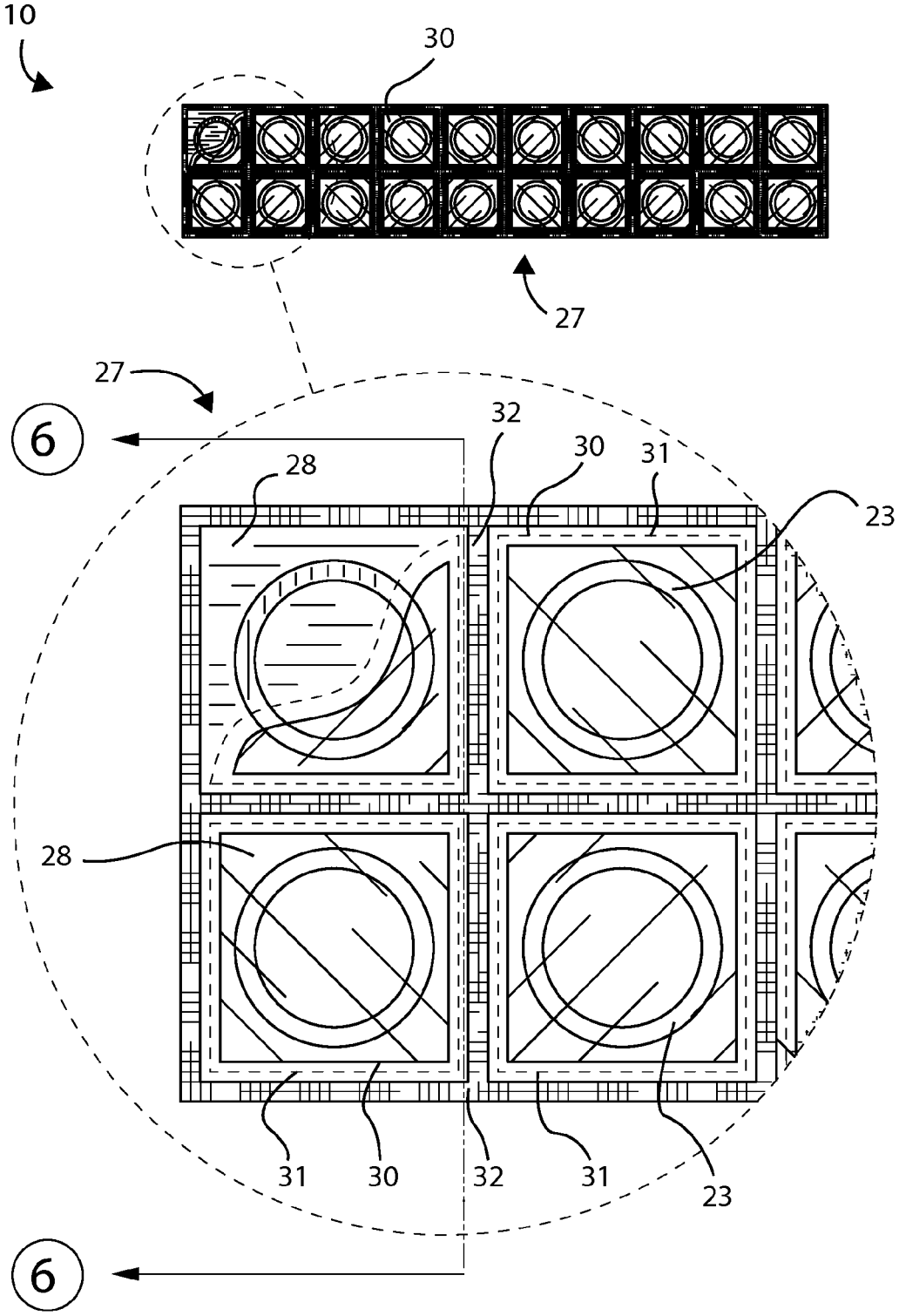
FIG. 5 is a cross sectional view, taken along line 5-5, as seen in FIG. 4.
Figure 6:
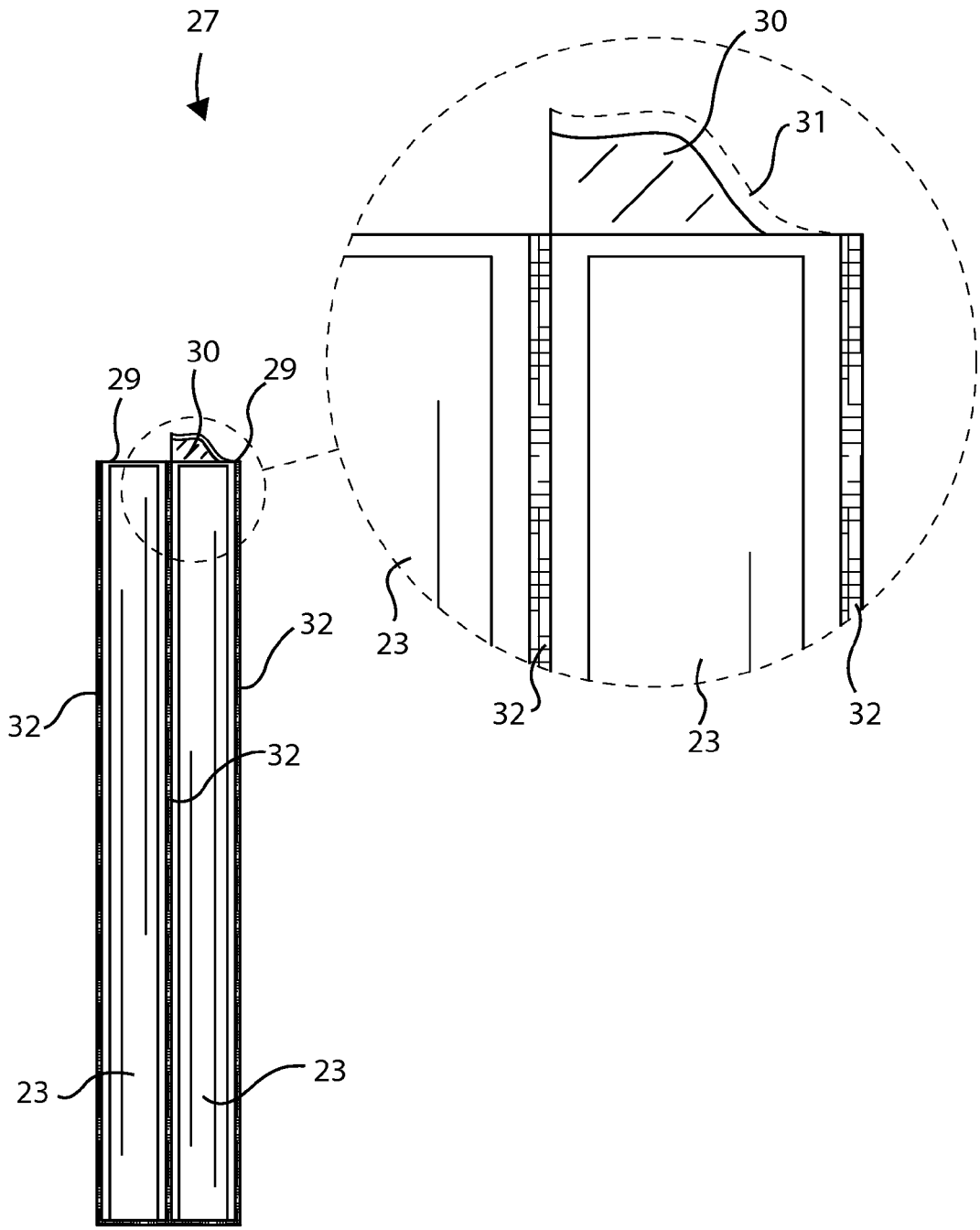
FIG. 6 is a cross sectional view, taken along line 6-6, as seen in FIG. 5.

Referring to FIGS. 5 and 6, the apparatus 10 further includes a mechanism 27 for maintaining the rolled tobacco leaves 23 in a sealed and air-tight condition while nested within the carrying case 20 so that the rolled tobacco leaves 23 are prevented from becoming saturated with humidity in ambient air. Such a sealed and air-tight maintaining mechanism 27 includes a plurality of isolated compartments 28 formed within the carrying case 20. Each of such compartments 28 is juxtaposed side-by-side and vertically oriented along an entire width of the carrying case 20. Each of the compartments 28 further has open top ends 29 evenly situated along the open top end 21 of the carrying case 20.

The maintaining mechanism 27 further includes a segmented sheet of water-impermeable material 30 covering an entire surface area of the open top end 21 of the carrying case 20. Such a segmented sheet 30 includes a plurality of perforations 31 defining lines of weaknesses situated along perimeters of the compartments 28 and along which a plurality of sheet segments 30 are removably affixed to the top ends of the compartments respectively which is vital such that selected ones of the sheet segments 30 are independently detachable from corresponding ones of the compartments 28 while remaining ones of the sheet segments 30 stay attached to corresponding ones of the compartments 28 during non-use conditions. Each of the sheet segments 30 is uniformly situated along a perimeter of the open top ends 29 of the compartments 28, and each of the compartments 28 shares at least two side walls 32 with an adjoining compartment respectively. The maintaining mechanism 27 ensures that the wrappers do not stick together in the carrying case 20, thereby ensuring easy removal from the case.

In an alternate embodiment of the apparatus 10', referring to FIGS. 10-15, the carrying case 20' will not provide compartments. Instead, each individual tobacco leaf wrapper 23' will be individually wrapped in a transparent protective covering 50 to maintain maximum freshness of the leaf.

In use, the wrappers for tobacco products and the like is simple and straightforward to operate. Having already decided on the desired tobacco for filling the leaf, the user now is ready to roll their cigarette. After placing a wrapper leaf on a flat surface with the adhesive side facing up, the user then spreads the chosen tobacco grains onto the leaf. The user evenly distributes the tobacco along the entire length of the leaf, running parallel to the adhesive strip. Using their fingers as a guide, the user then gently folds the side to the opposite of the strip, so that it covers the tobacco. The wrapper is then rolled forward toward the adhesive, which is effectively used to easily and securely seal the contents of this newly-created cigarette. Using standard scissors or cap punches specially designed for cigars, the user cut and shapes each end of the cigarette to create a more professional-looking smoke.

The present invention, as claimed, provides the unexpected and unpredictable benefit of allowing a user to wrap their own cigarettes with their choice of tobacco product. In addition, the tobacco leaf wrappers add flavor and aesthetic appeal to any cigarette. The maintaining mechanism ensures that each tobacco leaf remains of high quality. Such benefits overcome the prior art shortcomings.

The apparatus includes a plurality of rectangular-shaped tobacco leaves that are convenient for the rolling of cigarettes at one's leisure. Such wrappers are housed in a stay-fresh container that is produced of plastic material. Each container effectively holds twenty quality-cured, sun-grown leaf wrappers. Of course, the container may be produced in a variety of sizes for holding more or less wrappers therein, as is obvious to a person of ordinary skill in the art. Each wrapper is rectangular-shaped and measuring five inches in length and two inches in width to resemble standard cigarette wrapping paper. Of course, the wrappers may be produced in a variety of alternate sizes, as is obvious to a person of ordinary skill in the art. Each wrapper also includes a thin adhesive strip. Such a strip serves as a sealant for the tobacco filler, which is crucial for maintaining the wrapper at a rolled state. Such a strip is positioned on the inside of each leaf and stretches along the entire length thereof.

The present invention provides an apparatus that is convenient and easy to use, is lightweight and portable in design, is relatively inexpensive to produce, and provides an inexpensive and useful means for cash-strapped users to create their own cigarettes. By using carefully cured, superior quality tobacco leaves, the wrappers can furnish a sturdy, durable casing for any chosen filler for smoking. In addition, the flavorful leaves offer cigarette lovers a smooth, long-burning smoke, with an effortless draw and a pleasing aroma.

Through facilitating more secured filler inside the cigar, the present invention's unique adhesive strip further eliminates the need to resort to gummy paper varieties that may not remain intact. In this manner, awkward resealing attempts and messy cleanups of filler are avoided.

As these leaves are conveniently packaged in a sealed, airtight pouch, users can be assured of a fresh wrapper each time they roll their own cigarette. Additionally, these attention-garnering cigarettes certainly peak the interest of curious bystanders, breaking the ice and encouraging conversation. Versatile and convenient, this product can be used with a wide variety of filler tobaccos including such popular blends as American Spirit®, Paladin®, and Velvet®. Though the wrappers are geared primarily toward young adult smokers, virtually any cigarette aficionado can use this handy product.

In use, a method for utilizing combined tobacco leaf-rolled wrappers and packaging for creating home-made cigarettes includes the steps of: providing a water-impermeable carrying case 20 with an open top end 21 that is provided with a lid 22 pivotally coupled to a longitudinal side thereof such that the lid 22 covers the top end 21 when articulated to a closed position; providing a plurality of flexible and uniformly shaped tobacco leaves 23 adapted to a rolled and tubular position; separately housing each of the rolled tobacco leaves 23 within the carrying case 20 by spacing each of the rolled tobacco leaves 23 from each other; and maintaining the rolled tobacco leaves 23 in a sealed and air-tight condition while nested within the carrying case 20 so that the rolled tobacco leaves are prevented from becoming saturated with humidity in ambient air.

In use, the method further includes the step of providing a plurality of isolated compartments 28 formed within the carrying case 20. Each of such compartments 28 is juxtaposed side-by-side and vertically oriented along an entire width of the carrying case 20, and each of the compartments 28 has open top ends 29 evenly situated along the open top end 21 of the carrying case 20. The steps further include: positioning a segmented sheet of water-impermeable material 30 over an entire surface area of the open top end 21 of the carrying case 20; perforating the segmented sheet 30 by defining lines of weaknesses along perimeters of the compartments 28 such that a plurality of sheet segments 30 are removably affixed to the top ends 29 of the compartments 28 respectively; and independently detaching selected ones of the sheet segments 30 from corresponding ones of the compartments 28 while remaining ones of the sheet segments 30 stay attached to corresponding ones of the compartments 28 during non-use conditions.

In use, the method further includes the steps of: contiguously conjoining an adhesive layer 24 to a top surface of each of the rolled tobacco leaves 23 by spanning the adhesive layer 24 along a first longitudinal edge thereof; and pressing an outer surface 26 of the rolled tobacco leaves 23 against the adhesive layer 24 during smoking procedures.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. Combined tobacco leaf-rolled wrappers and packaging for creating home-made cigarettes, said combined tobacco leaf-rolled wrappers and packaging comprising:

a carrying case having an open top end and being provided with a lid pivotally coupled to a longitudinal side thereof such that said lid covers said top end when articulated to a closed position;

a plurality of flexible tobacco leaves adapted to a rolled and tubular position, each of said rolled tobacco leaves being separately housed within said carrying case and spaced from each other; and means for maintaining said rolled tobacco leaves in a sealed and air-tight condition while nested within said carrying case so that said rolled tobacco leaves are prevented from becoming saturated with humidity in ambient air;

wherein said sealed and air-tight maintaining means comprises:

a plurality of isolated compartments formed within said carrying case, each of said compartments being juxtaposed side-by-side and vertically oriented along an entire width of said carrying case, each of said compartments having open top ends evenly situated along said open top end of said carrying case; and a segmented sheet of water-impermeable material covering an entire surface area of said open top end of said carrying case, said segmented sheet including a plurality perforations defining lines of weaknesses situated along perimeters of said compartments and along which a plurality of sheet segments are removably affixed to said top ends of said compartments respectively such that selected ones of said sheet segments are independently detachable from corresponding ones of said compartments while remaining ones of said sheet segments stay attached to corresponding ones of said compartments during non-use conditions.

2. The combined tobacco leaf-rolled wrappers and packaging of claim 1, wherein each of said rolled tobacco leaves comprises: an adhesive layer contiguously conjoined to a top surface of each of said rolled tobacco leaves and spanning along a first longitudinal edge thereof, wherein an outer surface of said rolled tobacco leaves is pressed against said adhesive layer during smoking procedures.

3. The combined tobacco leaf-rolled wrappers and packaging of claim 1, wherein each of said sheet segments is uniformly situated along a perimeter of said open top ends of said compartments.

4. The combined tobacco leaf-rolled wrappers and packaging of claim 1, wherein said rolled tobacco leaves are coextensively shaped.

5. Combined tobacco leaf-rolled wrappers and packaging for creating home-made cigarettes, said combined tobacco leaf-rolled wrappers and packaging comprising:

a water-impermeable carrying case having an open top end and being provided with a lid pivotally coupled to a longitudinal side thereof such that said lid covers said top end when articulated to a closed position;

a plurality of flexible and uniformly shaped tobacco leaves adapted to a rolled and tubular position, each of said rolled tobacco leaves being separately housed within said carrying case and spaced from each other; and means for maintaining said rolled tobacco leaves in a sealed and air-tight condition while nested within said carrying case so that said rolled tobacco leaves are prevented from becoming saturated with humidity in ambient air;

wherein said sealed and air-tight maintaining means comprises:

a plurality of isolated compartments formed within said carrying case, each of said compartments being juxtaposed side-by-side and vertically oriented along an entire width of said carrying case, each of said compartments having open top ends evenly situated along said open top end of said carrying case; and a segmented sheet of water-impermeable material covering an entire surface area of said open top end of said carrying case, said segmented sheet including a plurality perforations defining lines of weaknesses situated along perimeters of said compartments and along which a plurality of sheet segments are removably affixed to said top ends of said compartments respectively such that selected ones of said sheet segments are independently detachable from corresponding ones of said compartments while remaining ones of said sheet segments stay attached to corresponding ones of said compartments during non-use conditions.

6. The combined tobacco leaf-rolled wrappers and packaging of claim 5, wherein each of said rolled tobacco leaves comprises: an adhesive layer contiguously conjoined to a top surface of each of said rolled tobacco leaves and spanning along a first longitudinal edge thereof, wherein an outer surface of said rolled tobacco leaves is pressed against said adhesive layer during smoking procedures.

7. The combined tobacco leaf-rolled wrappers and packaging of claim 5, wherein each of said sheet segments is uniformly situated along a perimeter of said open top ends of said compartments.

8. The combined tobacco leaf-rolled wrappers and packaging of claim 5, wherein said rolled tobacco leaves are coextensively shaped.

* * * * *